United States Patent [19]

Zechlin et al.

[11] 4,404,951

[45] Sep. 20, 1983

[54] IGNITION CONTROL BOX ASSEMBLY FOR INTERNAL COMBUSTION ENGINE

[75] Inventors: Richard Zechlin, Beloit; Robert M. Henderson, Williams Bay, both of Wis.

[73] Assignee: Colt Industries Operating Corp., New York, N.Y.

[21] Appl. No.: 422,845

[22] Filed: Sep. 24, 1982

[51] Int. Cl.[3] ..... F02P 1/00

[52] U.S. Cl. ..... 123/595; 123/647

[58] Field of Search ..... 123/595, 647

[56] References Cited

U.S. PATENT DOCUMENTS

| | | | |
|---|---|---|---|
| 4,155,340 | 5/1979 | Fernquist | 123/647 |
| 4,198,943 | 4/1980 | Worz | 123/647 |
| 4,248,201 | 2/1981 | Tsutsui | 123/647 |

*Primary Examiner*—Ronald B. Cox

*Attorney, Agent, or Firm*—Sixbey, Friedman & Leedom

[57] ABSTRACT

The ignition control box assembly is adapted to be retrofit onto an internal combustion engine and to maintain a hose for the engine against movement in all directions while providing electrical shielding for transformer assemblies mounted within the control box. A metallic chamber wall is formed integrally with back, top and bottom walls for an open sided housing, and extends from the backwall into the housing to form two separate compartments. The compartments are electrically shielded by two spaced metal walls formed by the chamber wall and the air gap provided by an open ended chamber defined by the chamber wall which extends angularly and vertically across the housing. The open side of the housing is closed and sealed by a removable closure assembly.

7 Claims, 5 Drawing Figures

IGNITION CONTROL BOX ASSEMBLY FOR INTERNAL COMBUSTION ENGINE

TECHNICAL FIELD

The present invention relates to breakerless ignition systems generally, and more particularly to a novel control box structure for receiving the electronic control components of a capacitive discharge ignition system which is adapted to be retrofit on a standard small horsepower gasoline engine to replace existing breaker point ignitions.

BACKGROUND ART

Recent developments in breakerless ignition system technology have made available highly efficient and reliable capacitive discharge ignition systems for internal combustion engines of all sizes. Initially, breakerless ignition systems were designed and used primarily for larger horsepower engines, but as electronic ignition systems of this type became more prevelant, the use of such systems in small horsepower internal combustion engines became highly feasible. Not only have breakerless ignition systems been recently installed in new low horsepower internal combustion engines, but the efficiency and reliability of these systems have led to an ever-increasing demand for retrofit units which can replace the breaker point ignitions presently installed in the tremendous number of low horsepower internal combustion engines presently in existence in the field.

When designing a breakerless ignition system to be retrofit on an existing engine, a number of unique problems and requirements must be met which do not normally arise with ignition systems which are installed in a new engine designed to receive the ignition system. For example, with retrofit units, it is often highly desirable that the unit to be attached to the engine does not either increase the engine profile or interfere with engine components which are already in place. This means that external components of the ignition system to be retrofit must be designed to operate effectively while accommodating existing engine components and maintaining the existing engine profile.

In previous breakerless ignition systems designed to be retrofit on existing engines, a particularly perplexing problem was presented by the ignition system control box which contains the highly inductive spark producing transformers for the breakerless ignition system plus associated control board circuitry. Due to the nature of these highly inductive transformers and the circuitry associated therewith, ignition control boxes are normally formed of heavy cast metal and must be both strong and water tight to protect the internal circuitry against the effects of moisture. In a retrofit system, the ignition control box is normally secured externally to an internal combustion engine, and the inherent bulky configuration of this box makes it extremely difficult to maintain the engine profile. When the box is reduced in size, the difficulty of providing effective shielding to isolate the ignition transformers within the box is increased, but of even greater importance is the fact that on many engines, the ideal location for such a box is in the exact location of an engine air inlet hose which extends from the engine air filter to the intake manifold. If the ignition control box is connected to the engine beneath this air inlet hose, the hose is forced outwardly beyond the engine profile and is exposed to impact damage from articles moving in the vicinity of the engine. In the past, this exposure of the engine air inlet hose with the attendant increase in the overall engine profile has proven unacceptable, and in an attempt to alleviate this problem, a cutaway portion was formed in the outer cover of the ignition control box and in the box body so that the hose may be freely received in the resulting indentation. Although this design permits the engine air inlet hose to be maintained within the confines of the existing engine profile, the structure was found to be subject to a number of disadvantages, some of which contributed to the malfunction of the ignition system in the engine. First, the formation of an indentation extending inwardly from the front or cover section of the ignition control box into the box body seriously weakened the overall box structure. A more important structural deficiency, however, was the fact that the mating edges of the box and the box cover were forced to follow the profile of this identation, and effective moistureproof gasketing along this irregular line proved to be impossible. Consequently, moisture was admitted to the circuitry and the transformers within the ignition control box.

Another disadvantage experienced with the previous control box having the engine air inlet hose receiving indentation in the cover thereof was the fact that the cover of the box could not be removed without first disconnecting the air inlet hose from the engine. Finally, the air inlet hose merely rested in an indentation in the box and was not positively retained by the box to preclude damage to the hose.

DISCLOSURE OF THE INVENTION

It is a primary object of the present invention to provide a novel and improved ignition control box which is especially adapted to be retrofit on an existing low horsepower internal combustion engine without substantially increasing the engine profile. The ignition control box is adapted to receive and positively retain the engine air inlet hose against movement in all directions and to protect the hose both from impact and from contact with the heated engine.

Another object of the present invention is to provide a novel and improved ignition control box which is adapted to provide internal shielding between highly inductive electronic ignition components mounted within the box. The box is designed to receive and positively retain the air inlet hose for the internal combustion engine without substantially weakening the box structure or inhibiting access to the box from the box cover.

A still further object of the present invention is to provide a novel and improved ignition control box for an internal combustion engine which is adapted to receive and positively retain against all directions of movement the air inlet hose for the engine without rendering the box susceptible to moisture. The contacting edges between the box and the box cover are all straight edges which may be effectively sealed by a moistureproof gasket.

These and other objects of the present invention will be readily apparent from a consideration of the following specification and claims taken in conjunction with the accompanying drawings.

BEST MODE FOR CARRYING OUT THE INVENTION

Figure 1:
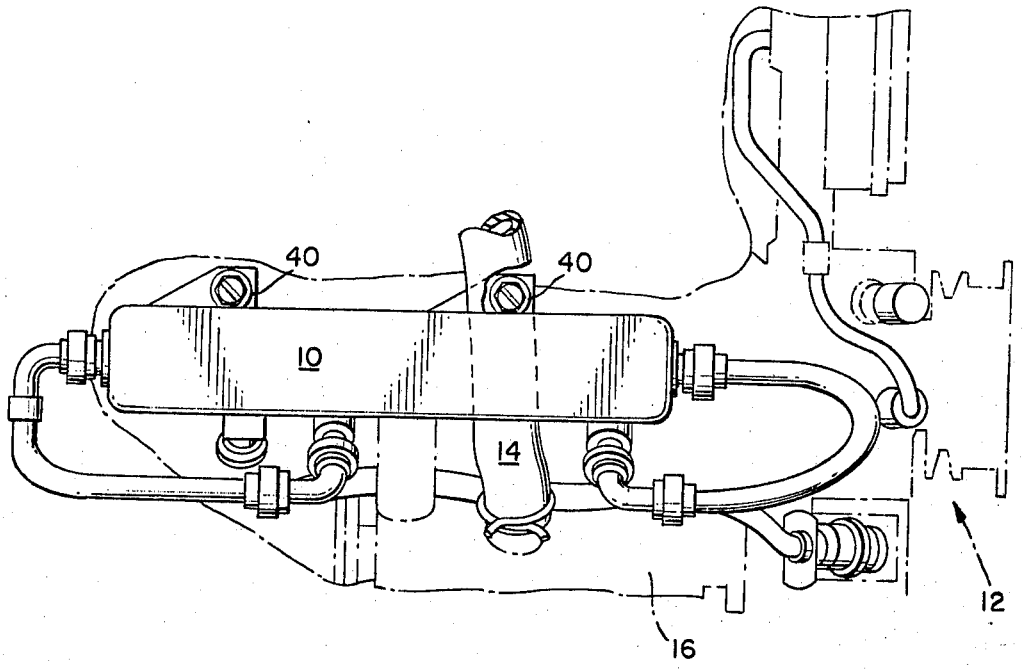
FIG. 1 is a diagrammatic view in side elevation of an internal combustion engine showing the ignition control box of the present invention in place.

Referring now to FIG. 1, the ignition control box of the present invention indicated generally at 10 is intended to be secured externally to an internal combustion engine 12 in the vicinity of an engine air inlet hose 14 which extends vertically and angularly from an air inlet filter to the engine manifold 16. The ignition control box 10 is designed to encompass the air inlet hose 14 and retain this hose in all directions of movement. Not only does the ignition control box protect the hose 14, but it also prevents the hose from contacting the heated portions of the engine 12.

Referring now to FIGS. 2–5, the ignition control box 10 consists primarily of a unitary cast metal housing 18 and a cover assembly 20. The housing 18 is defined by integrally cast walls including a top wall 22, a bottom wall 24 spaced therefrom and joining end walls 26 and a rear wall 28 to form an enclosure having an open front. It will be noted that the front edges of the top and bottom walls and end walls are straight and flat so as to mate with the surface of a corresponding flange 30 which extends around the periphery of a metal cover 32. A gasket 34 is mounted on the cover 32 between the flange 30 and the front edges of the top, bottom and end walls of the housing 18 to provide a waterproof seal when the cover is secured to the housing. This may be accomplished by suitable bolts or similar fasteners which extend from the front of the cover 32 through lugs 36 formed integrally on the cover and into threaded receiving apertures 38 in the rear wall 28 of the housing.

The ignition control box 10 is secured to the engine 12 by means of mounting flanges 40 which extend therefrom above the top wall 22. Bolts inserted through these mounting flanges securely fasten the ignition control box in place and simultaneously secure the air inlet hose 14.

To positively retain the air inlet hose against movement in all directions, the housing 18 is cast so as to provide a vertically extending chamber 42 which projects inwardly from the back wall 28 (FIG. 4) A wall 44 defining the chamber 42 is an integral extension of the back wall 28, and the chamber 42 opens through the top wall 22 and the bottom wall 24. Since the housing 18 is a unitary cast metal housing, the chamber wall 44 is formed integrally with both the back wall 28, the top wall 22, and the bottom wall 24. This provides a unitary construction of great strength, and additionally there is no likelihood that moisture can enter the housing 18 as a result of the chamber 42. The strength of the housing is additionally enhanced by the fact that the chamber 42 does not open completely across the extent of the back wall of the housing 28, but instead, back wall sections 46 and 48 adjacent the upper and lower ends of the chamber 42 bridge the chamber and maintain an undivided back wall between the end walls 26. The opening in the backwall 28 does facilitate injection molding of the housing without weakening the back wall structure.

Figure 2:
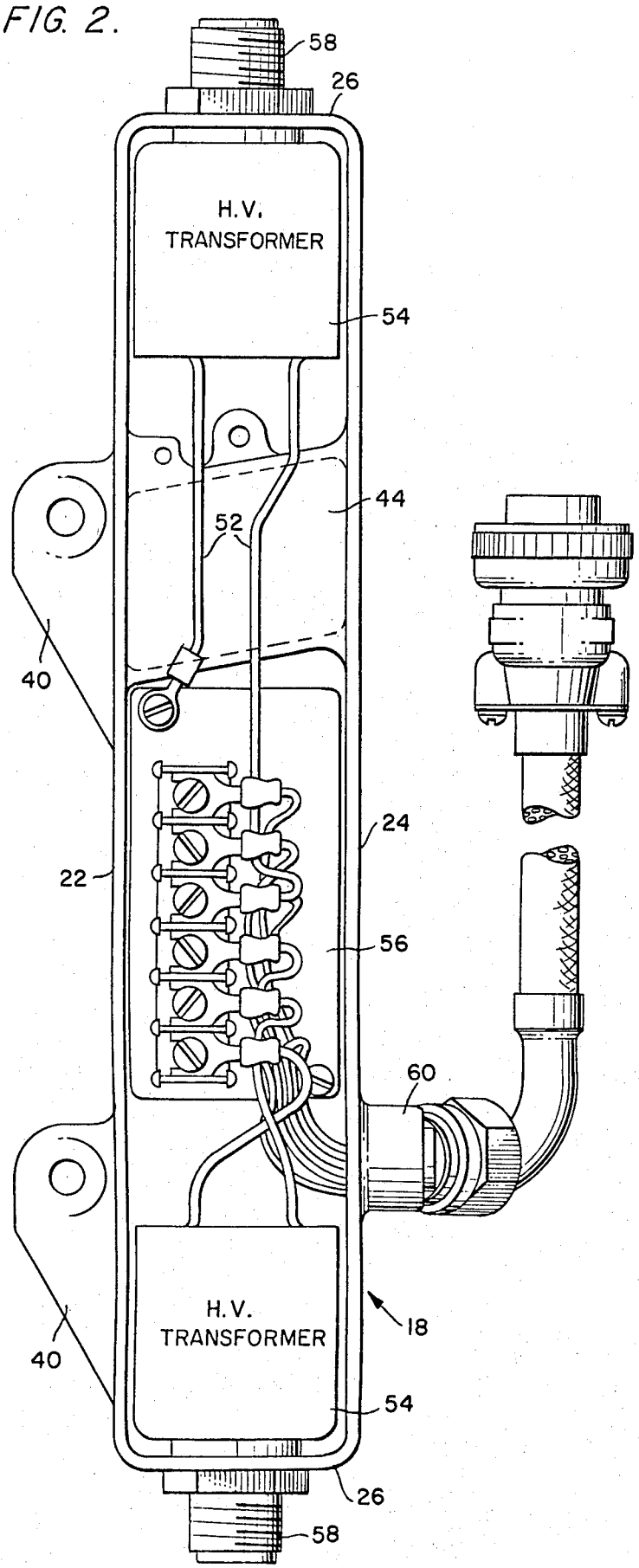
FIG. 2 is a view in front elevation of the ignition control box of the present invention with the cover removed.
Figure 3:
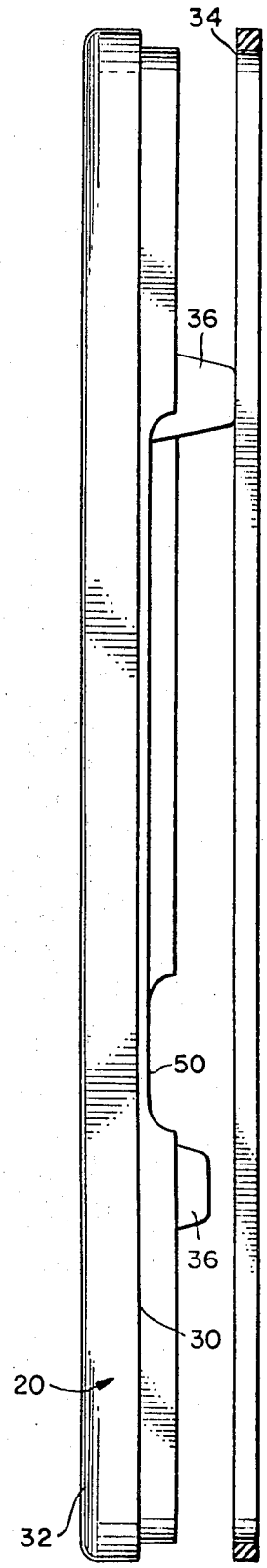
FIG. 3 is a plan view of the cover assembly for the ignition control box of FIG. 2.
Figure 4:
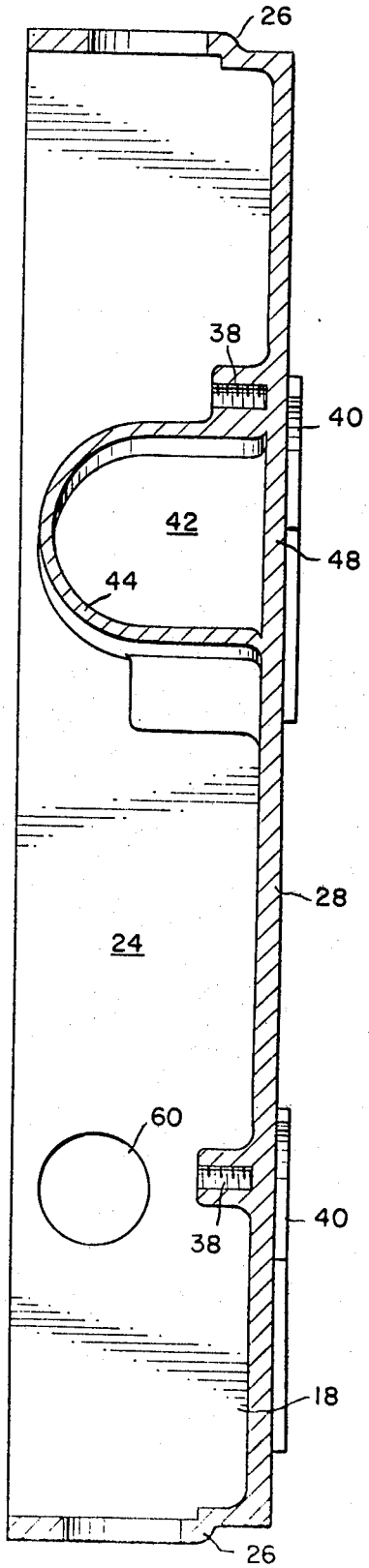
FIG. 4 is a longitudinal sectional view of the control box of FIG. 3.
Figure 5:
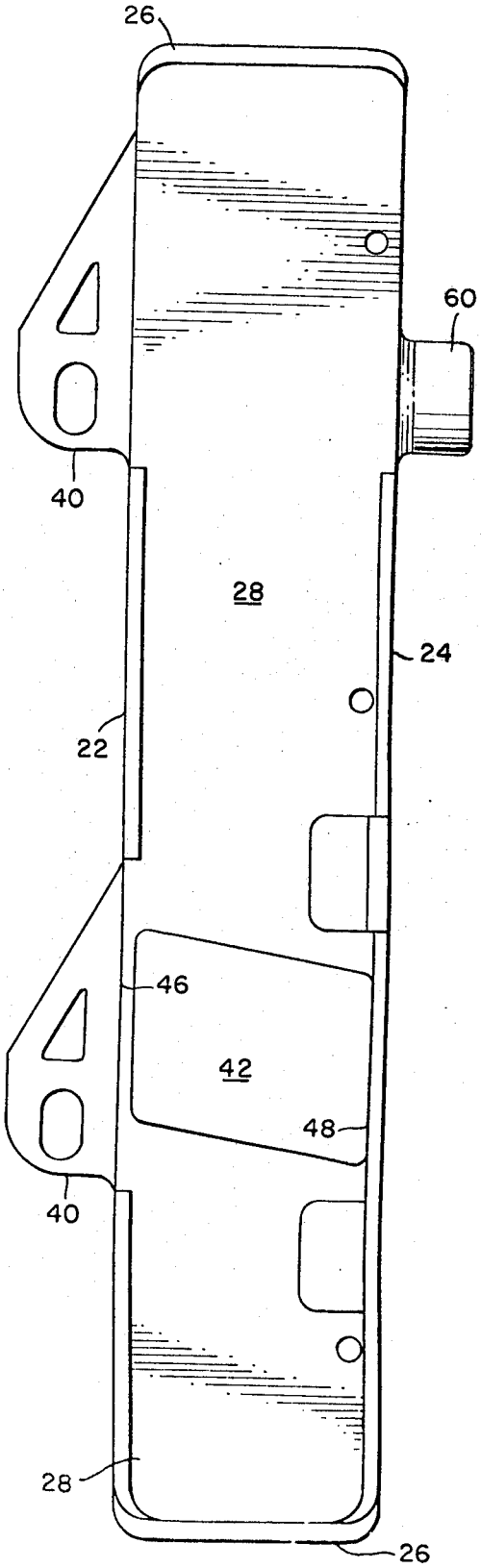
FIG. 5 is an elevational view of the back of the control box of FIG. 2.

It will be noted from FIGS. 2 and 5 that the central vertical axis of the chamber 42 is inclined relative to the central longitudinal axis of the housing 18. Thus the chamber 42 extends at an angle from the top wall 22 of the housing to the bottom wall 24 thereof, and this angle conforms to the angular path of the air inlet hose 14 between the manifold 16 and the air inlet filter for the engine 12. It will be noted from FIG. 4 that the wall 44 for the chamber 42 terminates inwardly from the outer edges of the top, bottom and end walls of the housing 18. This, combined with a cutaway portion 50 on the inner surface of the cover 32 which is positioned directly above the chamber wall 44 when the cover is in place provides a space for the passage of wiring 52, as illustrated in FIG. 2.

The metal housing 18 is designed to receive and mount a high voltage transformer 54 adjacent each end wall 26, and each such high voltage transformer is wired into a centrally located circuit board 56. It will be noted that the metallic wall 44 of the chamber 42 separates the two high voltage transformers and provides a shielding structure which isolates one transformer from the other. In effect, the chamber provides two spaced metal walls with an intermediate air gap between the two transformers. This air gap is then filled by the engine air inlet hose which is normally formed of electrical insulating material. With the cover assembly secured tightly in place on the housing 18, the transformers 54 and the circuit board 56 are sealed within a moisture-proof enclosure.

The metal housing 18 is provided with electrical connectors 58 for the transformers 54 on each end wall 26 and another electrical connector 60 on the bottom wall 24 for the circuit board 56.

INDUSTRIAL APPLICABILITY

When the internal combustion engine 12 is to be retrofit with a breakerless ignition system, the air inlet hose 14 is disconnected and threaded through the chamber 42 in the housing 18 of the ignition control box. The control box is then secured to the engine by means of bolts passing through the mounting flanges 40, and since the air inlet hose is in fact passing through the control box, the hose and control box are maintained within the original profile of the engine. Also, the chamber 42 retains the air inlet hose against movement in any direction. Although the chamber opens through a back wall 28 of the housing to facilitate injection molding of the chamber, the back wall sections 46 and 48 extend between the air inlet hose 14 and the engine and keep the hose away from the heated sections of the engine which might tend to damage the hose. With the ignition control box 10 in place on the engine, the cover assembly 20 thereof may be easily removed from the housing 18 without the necessity of disconnecting the air inlet hose 14. Also, strength is imparted to the housing by the chamber wall 44 which additionally operates to isolate the high voltage transformers 54. The fact that one mounting flange 40 bridges the chamber 42 also imparts additional strength to the housing 18, and when the mounting flanges are bolted to an engine, the engine structure bridges the chamber 42 and fortifies the strength of the backwall 28.

We claim:

1. An ignition control box assembly adapted to be retrofit onto an internal combustion engine and to maintain a hose for such engine against movement in all directions and within the confines of the engine profile comprising a unitary metal housing including spaced top and bottom walls, spaced endwalls extending between and integral with said top and bottom walls, a backwall integral with and extending between said top, bottom and endwalls on a back side of said housing to form an enclosure, the front side of said housing opposite said back side being open, and chamber means for retaining said hose against movement in all directions and isolating the hose from contact with said engine while providing magnetic isolation for electronic components within said enclosure, said chamber means including chamber wall means formed integrally with said top, bottom and backwalls and extending inwardly of said enclosure from said backwall toward the front side of said housing to define an open ended chamber extending between said top and bottom walls and having no opening into said enclosure, said top and bottom walls each including an opening within the confines of said chamber wall means to provide the open ends of said chamber, said chamber wall means being spaced from each of said endwalls to divide said enclosure into first and second compartments separated by said chamber, and a closure assembly means for closing the front side of said housing.

2. The ignition control box assembly of claim 1 wherein said chamber extends angularly from the top wall of said housing to the bottom wall thereof.

3. The ignition control box assembly of claim 2 wherein said chamber wall means extends substantially across said housing from said backwall toward the front side of said housing but is spaced slightly inwardly from the terminal edges of the walls defining the open front side of said housing.

4. The ignition control box assembly of claim 3 wherein said closure assembly means includes a cover and means to secure said cover to said housing to close the front side thereof, the surface of said cover which is adjacent said enclosure when the cover is secured to said housing having a cutaway portion positioned to provide a space between said cover and chamber wall means with the cover secured to said housing.

5. The ignition control box assembly of claim 4 wherein electrical connection means are formed on each endwall of said housing and on the bottomwall thereof to electrically connect components within said housing to external electrical units.

6. The ignition control box assembly of claim 5 wherein said housing includes mounting flanges extending from said housing above the top wall and adjacent to backwall thereof, one of said flanges being formed to extend across said chamber.

7. The ignition control box assembly of claim 3 which includes a first transformer assembly mounted in said first compartment and a second transformer assembly mounted in said second compartment, said second compartment also including electrical circuit means connected to said first and second transformer assemblies, and electrical connection lines extending from said first transformer assembly to said electrical circuit means through a space between said closure assembly means and said chamber wall means.

* * * * *